US007315126B2

(12) United States Patent
Theiss

(10) Patent No.: US 7,315,126 B2
(45) Date of Patent: Jan. 1, 2008

(54) FOLDED WAVEGUIDE TRAVELING WAVE TUBE HAVING POLEPIECE-CAVITY COUPLED-CAVITY CIRCUIT

(75) Inventor: Alan Theiss, Redwood, CA (US)

(73) Assignee: L-3 Communications Corporation, San Carlos, CA (US)

( * ) Notice: Subject to any disclaimer, the term of this patent is extended or adjusted under 35 U.S.C. 154(b) by 54 days.

(21) Appl. No.: 11/264,056

(22) Filed: Oct. 31, 2005

(65) Prior Publication Data

US 2006/0091830 A1 May 4, 2006

Related U.S. Application Data

(60) Provisional application No. 60/625,306, filed on Nov. 4, 2004.

(51) Int. Cl.
*H01J 25/34* (2006.01)

(52) U.S. Cl. ..... 315/3.5; 315/5.35; 315/404

(58) Field of Classification Search ..... 315/3.5, 315/5.35, 404, 500–507; 330/4.6
See application file for complete search history.

(56) References Cited

U.S. PATENT DOCUMENTS 5,754,006 A * 5/1998 Tonegawa ..... 315/3.5
6,593,695 B2 * 7/2003 Theiss ..... 315/3.5

* cited by examiner

*Primary Examiner*—Thuy V. Tran
*Assistant Examiner*—Dieu Hien Duong
(74) *Attorney, Agent, or Firm*—O'Melveny & Myers LLP

(57) ABSTRACT

An amplifying device comprises an electron gun emitting an electron beam, a collector spaced from the electron gun, the collector oriented to collect electrons of the electron beam emitted from the electron gun, and an interaction structure interposed between the electron gun and the collector. The interaction structure defines an electromagnetic path along which an applied electromagnetic signal interacts with the electron beam. The interaction structure further comprises a plurality of polepieces and a plurality of magnets, the polepieces each having an aligned opening to collectively provide an electron beam tunnel having an axis extending between the electron gun and the collector to define an electron beam path for the electron beam. The polepieces provide a magnetic flux path to the electron beam tunnel from the magnets. More particularly, the interaction structure further includes plural cavities defined therein interconnected to provide a coupled cavity circuit. At least one of the plurality of polepieces separate adjacent ones of the plural cavities and have an iris for coupling the electromagnetic signal therethrough. At least one of the plurality of polepieces further has a void aligned perpendicularly to the beam tunnel axis.

18 Claims, 8 Drawing Sheets

FOLDED WAVEGUIDE TRAVELING WAVE TUBE HAVING POLEPIECE-CAVITY COUPLED-CAVITY CIRCUIT

RELATED APPLICATION DATA

This application claims priority pursuant to 35 U.S.C. § 119(e) to provisional patent application Ser. No. 60/625,306, filed Nov. 4, 2004, for COMPACT W-BAND FOLDED WAVEGUIDE TRAVELING WAVE TUBE, the contents of which are incorporated by reference herein in its entirety.

BACKGROUND OF THE INVENTION

1. Field of the Invention

The present invention relates to microwave amplification tubes, such as a traveling wave tube (TWT) or klystron, and, more particularly, to a coupled cavity microwave electron tube that produces a broadband response at high frequencies.

2. Description of Related Art

Microwave amplification tubes, such as TWT's or klystrons, are well known in the art for enabling a radio frequency (RF) signal and an electron beam to interact in such a way as to amplify the power of the RF signal. A coupled cavity TWT typically includes a series of tuned cavities that are linked or coupled by irises (also know as notches or slots) formed between the cavities. A microwave RF signal induced into the tube propagates through the tube, passing through each of the respective coupled cavities. At relatively high frequencies (e.g., around 100 GHz), a typical coupled cavity TWT may have a hundred or more individual cavities coupled in this manner. Thus, the TWT appears as a folded waveguide in which the meandering path that the RF signal takes as it passes through the coupled cavities of the tube reduces the effective speed of the signal enabling the electron beam to operate effectively upon the signal. Thus, the reduced velocity waveform produced by a coupled cavity tube of this type is known as a "slow wave."

Each of the cavities is linked further by an electron beam tunnel that extends the length of the tube and through which an electron gun projects an electron beam. The electron beam is guided by magnetic fields that are induced into the beam tunnel region. The folded waveguide guides the RF signal periodically back and forth across the drifting electron beam. Thus, the electron beam interacts with the RF signal as it travels through the tube to produce the desired amplification by transferring energy from the electron beam to the RF wave.

The magnetic fields that are induced into the tunnel region are obtained from flux lines that flow through polepieces from magnets lying outside the tube region. The polepiece is typically made of permanent magnetic material, which channels the magnetic flux to the beam tunnel. This type of electron beam focusing is known as Periodic Permanent Magnet (PPM) focusing. The iron polepieces extend directly into the interaction region between the RF signal and the electron beam, thereby forming an integral part of the folded waveguide circuit. The introduction of the polepieces into the circuit serves two purposes. First, it increases the stability parameter ($\lambda_p$/L) of the magnetic focusing field for the beam, thereby reducing the beam voltage requirements for operation at the same frequency and output power. Second, it facilitates the efficient transfer of heat out of the circuit by allowing the circuit to be made of solid copper in the orthogonal transverse region, making the overall design more robust and suited for harsh operating environments, such as in certain military applications.

Klystrons are similar to coupled cavity TWTs in that they can comprise a number of cavities through which an electron beam is projected. The klystron amplifies the modulation on the electron beam to produce a highly bunched beam containing an RF current. A klystron differs from a coupled cavity TWT in that the klystron cavities are not generally coupled. A portion of the klystron cavities may be coupled, however, so that more than one cavity can interact with the electron beam. This particular type of klystron is known as an extended interaction klystron.

For a coupled cavity circuit, the bandwidth over which the amplification of the resulting RF output signal occurs is typically controlled by altering the dimensions of the cavities and coupling irises. The power of the RF output signal is typically controlled by altering the voltage and current characteristics of the electron beam. There is an inverse relationship between the frequency of the RF output signal and the size of the cavities. In other words, where it is desired that the coupled cavity circuit propagate higher frequencies, the cavity size for the circuit must be made smaller. On the other hand, for the coupled cavity circuit to propagate more frequencies, the coupling iris size must be made larger.

Typically in order to maximize the magnetic flux transported to the beam tunnel by the polepieces, the polepieces are made as thick as possible and the cavities are located between the polepieces. But, as operating frequencies become higher, one must reduce the thickness of the polepieces if cavities are to be placed between them. This results in reduced flux in the beam tunnel, reduced beam power and lower RF output power. A coupled cavity circuit that propagates higher and more frequencies at higher power would be advantageous. Accordingly, for high power applications, it would be desirable to provide a coupled cavity circuit that utilizes thicker polepieces in order to utilize higher power electron beams, while at the same time maintaining the desired size and number of cavities between the polepieces.

SUMMARY OF THE INVENTION

The invention overcomes the drawbacks of the prior art by providing a microwave amplification device having a coupled cavity circuit that maximizes the periodic permanent magnet (PPM) stability parameter ($\lambda_p$/L) of the magnetic flux transported to the beam tunnel, while at the same time increasing the number of cavities and decreasing the spacing between cavities by disposing cavities within the polepieces. This provides higher magnetic flux levels in the beam tunnel, enabling the focusing of higher powered electron beams and higher RF output power.

In an embodiment of the invention, an amplifying device comprises an electron gun emitting an electron beam, a collector spaced from the electron gun, the collector oriented to collect electrons of the electron beam emitted from the electron gun, and an interaction structure interposed between the electron gun and the collector. The interaction structure defines an electromagnetic path along which an applied electromagnetic signal interacts with the electron beam. The interaction structure further comprises a plurality of polepieces and a plurality of magnets, the polepieces each having an aligned opening to collectively provide an electron beam tunnel having an axis extending between the electron gun and the collector to define an electron beam path for the electron beam. The polepieces provide a magnetic flux path to the electron beam tunnel from the magnets.

More particularly, the interaction structure further includes plural cavities defined therein interconnected to provide a coupled cavity circuit. At least one of the plurality of polepieces separate adjacent ones of the plural cavities and have an iris for coupling the electromagnetic signal therethrough. At least one of the plurality of polepieces further has a void aligned perpendicularly to the beam tunnel axis. The plurality of polepieces are comprised of ferromagnetic material. The polepieces may further comprise a first thickness in a first region adjacent to the respective aligned opening and a second thickness in a second region displaced from the aligned opening, the first thickness being smaller than the second thickness. The void may be disposed substantially within the polepiece, or may be disposed at a side surface of the polepiece.

A more complete understanding of the folded waveguide traveling wave tube having a polepiece-cavity coupled-cavity circuit will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention satisfies the need for a traveling wave tube having a coupled cavity circuit that utilizes thicker polepieces in order to utilize higher power electron beams, while at the same time maintaining the desired size and number of cavities between the polepieces. In the detailed description that follows, like element numerals are used to describe like elements illustrated in one or more figures.

Figure 1:
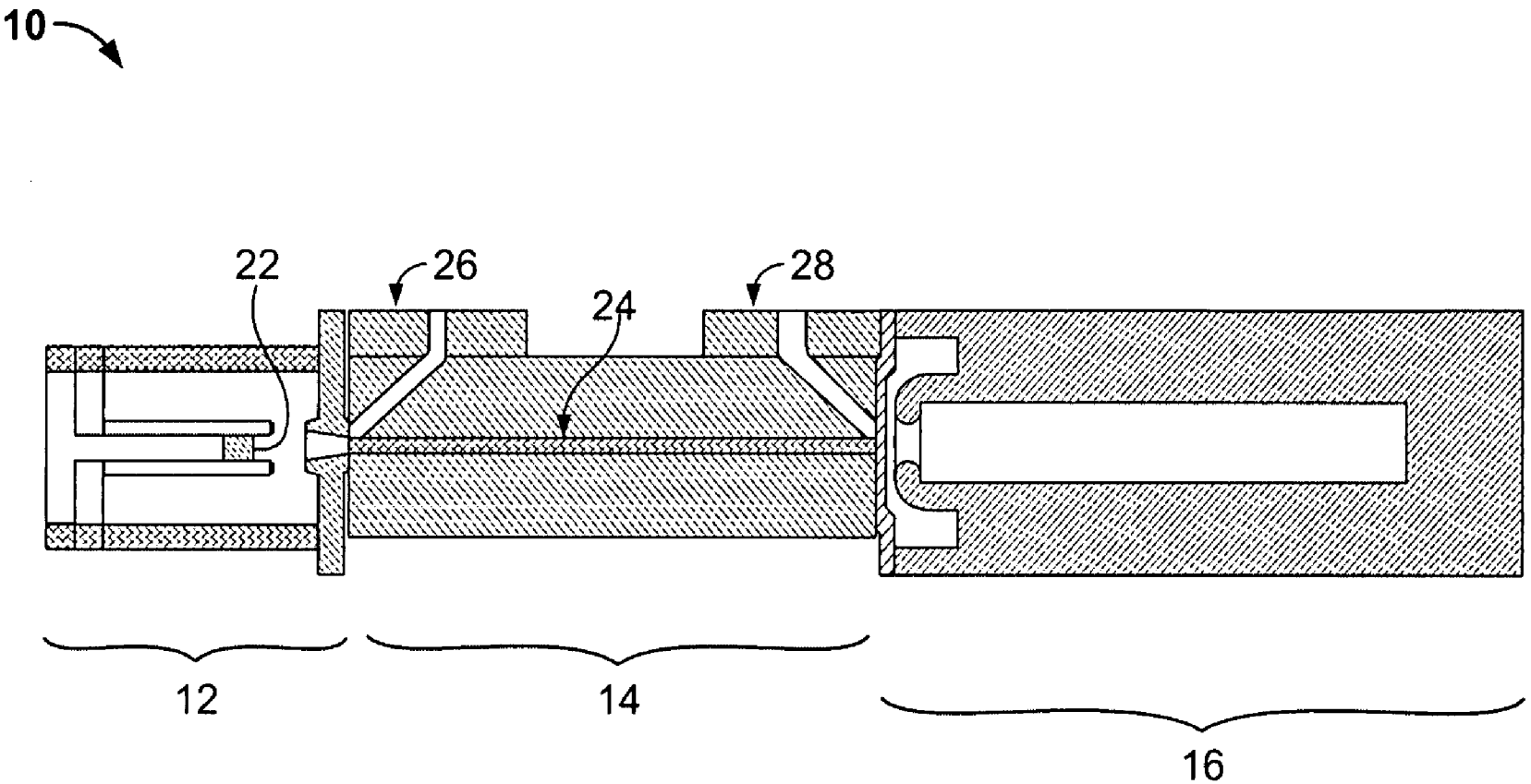
FIG. 1 is a sectional side view of an exemplary traveling wave tube amplification device including an electron gun, coupled cavity circuit, and collector.

Referring first to FIG. 1, an exemplary traveling wave tube (TWT) amplifier 10 is illustrated as including an electron gun 12, an interaction section 14, and a collector 16. The electron gun 12 generally includes a cathode surface 22 with a thermionic heating element disposed below the surface. An electron beam is drawn from the cathode surface 22 by activating the heating element and applying a highly negative voltage to the cathode. The electron beam travels axially through a drift tube 24 formed in the interaction section and is deposited in the collector 16. The interaction section 14 includes a coupled cavity circuit that enables the electron beam to interact with an RF signal, and thereby transfer energy to the RF signal. The interaction section 14 further includes an RF input port 26 and an RF output port 28. The RF input port 26 permits the injection of an input RF signal into the coupled cavity circuit, and the RF output port 28 permits the extraction of an amplified RF signal from the coupled cavity circuit. After passing through the interaction section 14, the spent electron beam is deposited into the collector 16, which recovers the remaining energy of the electron beam.

Figure 2:
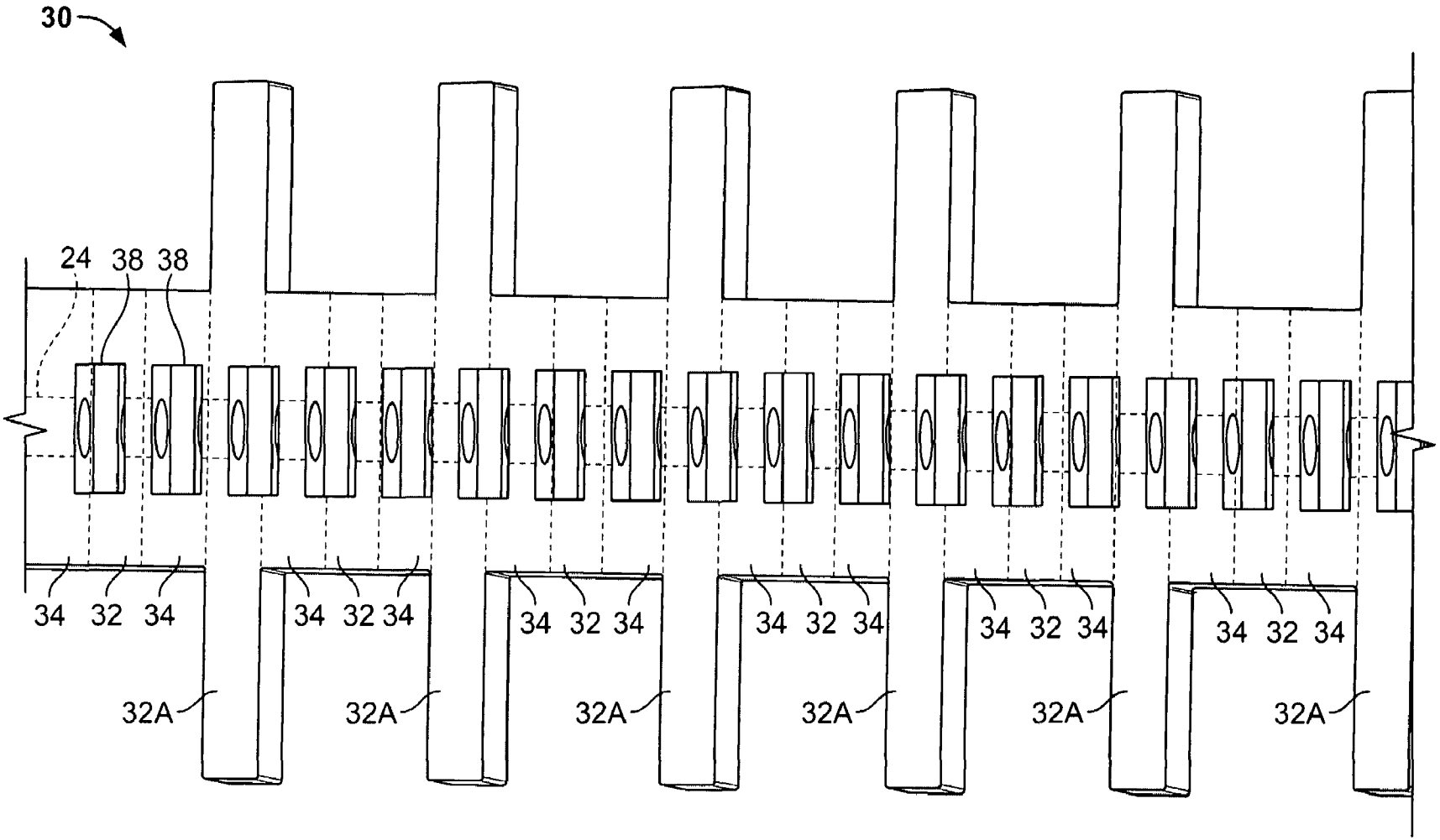
FIG. 2 is a partial perspective view of an exemplary coupled cavity circuit for use in the TWT amplification device of FIG. 1.

A portion of an integral polepiece coupled cavity circuit is shown in greater detail in FIG. 2. The coupled cavity circuit 30 is formed from a laminate structure comprising a plurality of non-ferromagnetic plates 34 and ferromagnetic conductive plates 32 that are alternatingly assembled and combined to form an integral structure. The preferred material for the ferromagnetic plates 32 is iron, and the preferred material for the non-ferromagnetic plates 34 is copper. As will be further described below, the ferromagnetic plates 32 provide polepieces that conduct magnetic flux to the beam tunnel to provide focusing of the electron beam. The coupled cavity circuit 30 is elongated and generally rectangular, providing generally flat external surfaces. The ferromagnetic plates 32 and non-ferromagnetic plates 34 have generally uniform ends, except that every other one of the ferromagnetic plates 32A is elongated to extend beyond the uniform ends. This provides a space for attachment of permanent magnets, as will be further described below. The electron beam tunnel 24 extends axially through the length of the coupled cavity circuit 30, passing through a plurality of cavities 38 formed within the coupled cavity circuit. The cavities 38 are formed within the non-ferromagnetic plates 34 (i.e., between the ferromagnetic plates 32), and are coupled by notches (i.e., coupling irises) formed in the ferromagnetic plates. The construction of an exemplary integral polepiece coupled cavity circuit is described in further detail in U.S. Pat. Nos. 5,332,948 and 5,332,947, the subject matter of which are incorporated herein by reference.

Magnetic focusing is used to guide the electron beam through the beam tunnel 24. Permanent magnets are commonly used for focusing the electron beam due to their relatively low weight as compared to a solenoid type magnet (referred to as periodic permanent magnet (PPM) focusing). In PPM focusing, the polepieces direct magnetic flux from the magnets into the beam tunnel in a path which runs through the magnets to the polepieces. Next, the flux travels radially inward through the polepieces to the beam tunnel, and jumps across the gap formed by the non-magnetic conductive plates 34 to the adjacent polepieces (i.e., ferromagnetic plates 32). The flux then returns radially outward through the polepieces to the magnets. By alternating the direction of the polarity of the magnets, a periodically alternating magnetic field is produced in the beam tunnel 24. As the electron beam traverses the alternating magnetic field, the beam develops a rotational motion which oscillates back and forth in alternating directions. This rotation compresses the beam to counteract space-charge forces that would otherwise undesirably expand the beam.

In accordance with the teachings of the present invention, a PPM-type coupled cavity circuit is provided with cavities not only between polepieces but also in the centers of polepieces. More particularly, the invention contemplates the introduction of voids into the low-field regions of the PPM magnetic field to form part of the folded-waveguide channel. These regions occur in the center of the polepieces, whether they be inside cusps of the large polepieces or in magnetic field minimums of the small polepieces.

Figure 3:
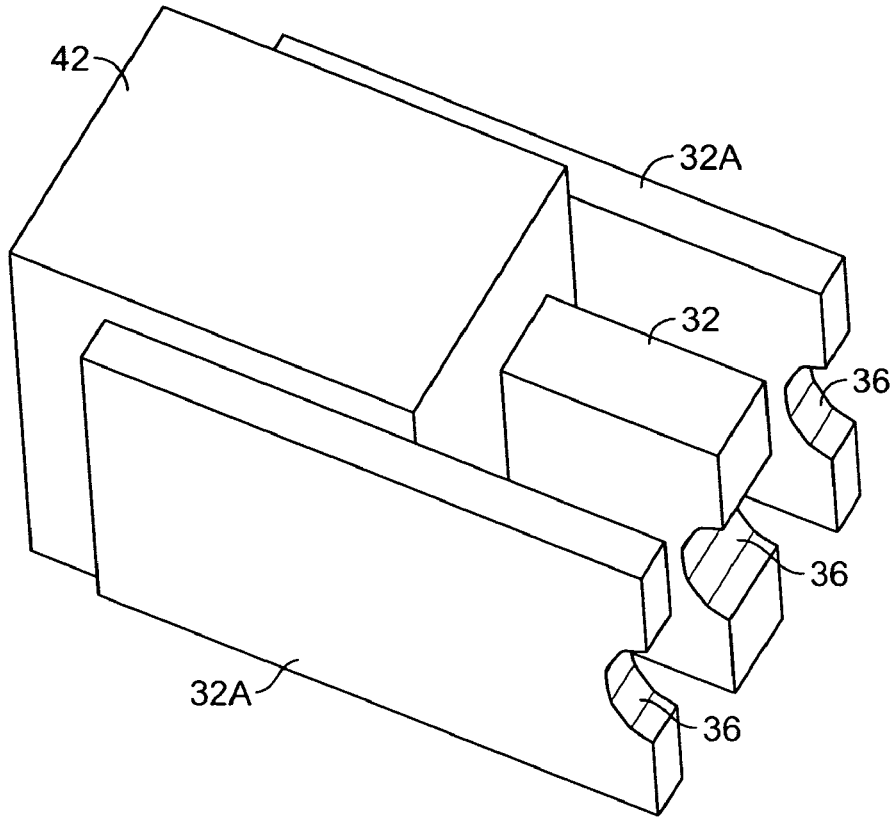
FIG. 3 is a partial perspective view of a portion of a conventional PPM circuit without RF coupling irises.

Referring to FIG. 3, an exemplary portion of the PPM coupled cavity circuit is shown. The conventional coupled cavity circuit includes adjacent elongated polepieces 32A interspersed with ordinary (short) polepiece 32 therebetween. The non-magnetically conductive plates are not shown in the figure. A permanent magnet 42 is disposed in the space defined between the elongated polepieces 32A, with the short polepiece 32 abutting the permanent magnet. Semicircular openings are formed at ends of the polepieces 32A, 32 denoting the electron beam tunnel. It should be appreciated that there are no coupling irises (i.e., notches) formed in the polepieces to permit communication of an RF signal between adjacent cavities.

Figure 4:
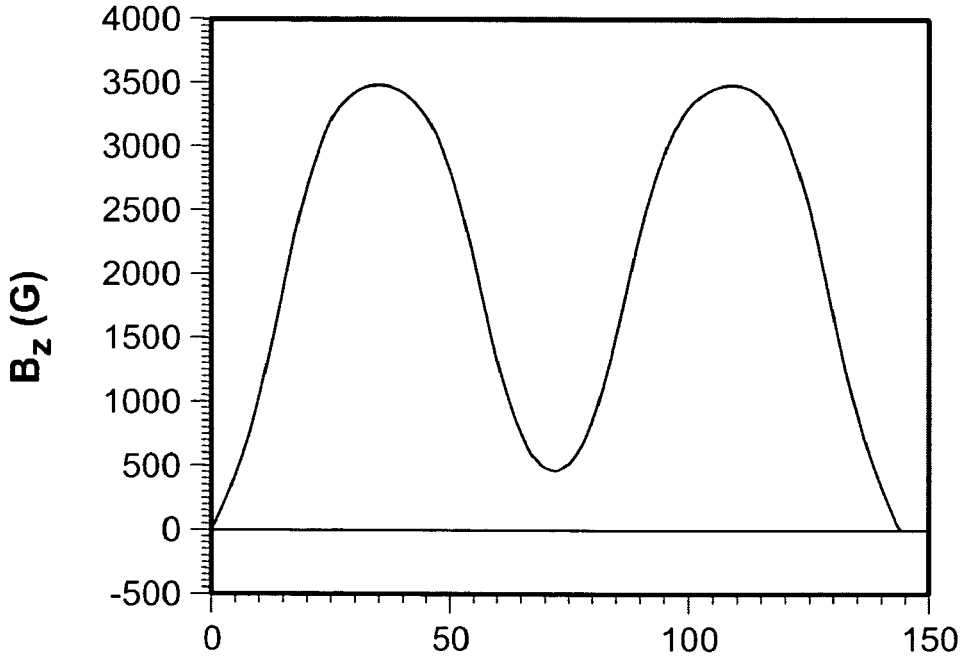
FIG. 4 is a graph illustrating the axial magnetic field measured inside the beam tunnel for the PPM circuit of FIG. 3.

FIG. 4 provides a graph illustrating the axial magnetic field measured inside the beam tunnel for the coupled cavity circuit of FIG. 3, in which the vertical axis defines the measured magnetic field and the horizontal axis defines the axial position within the beam tunnel. The graph reflects a regular, sinusoidally varying magnetic field.

Figure 6:
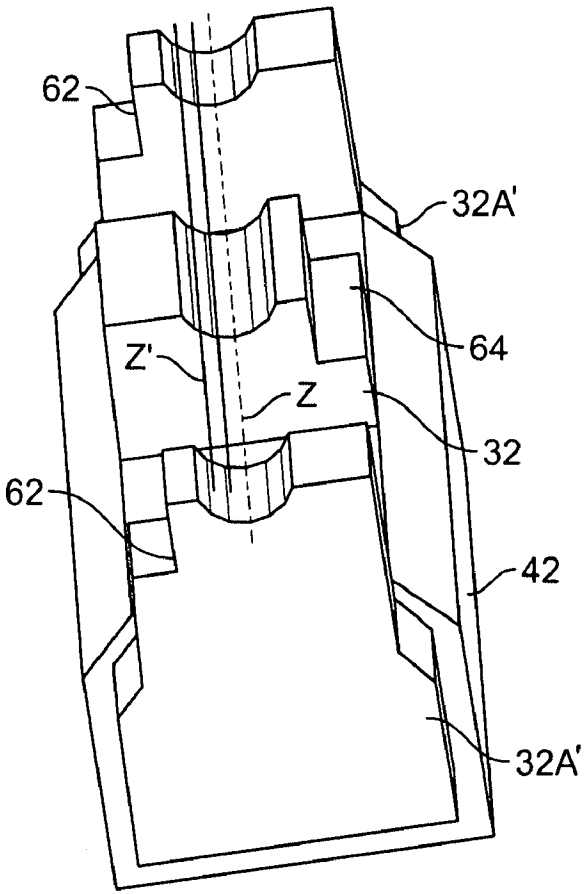
FIG. 6 is a partial perspective view of a portion of the notched PPM circuit showing off-axial measurement lines.
Figure 5:
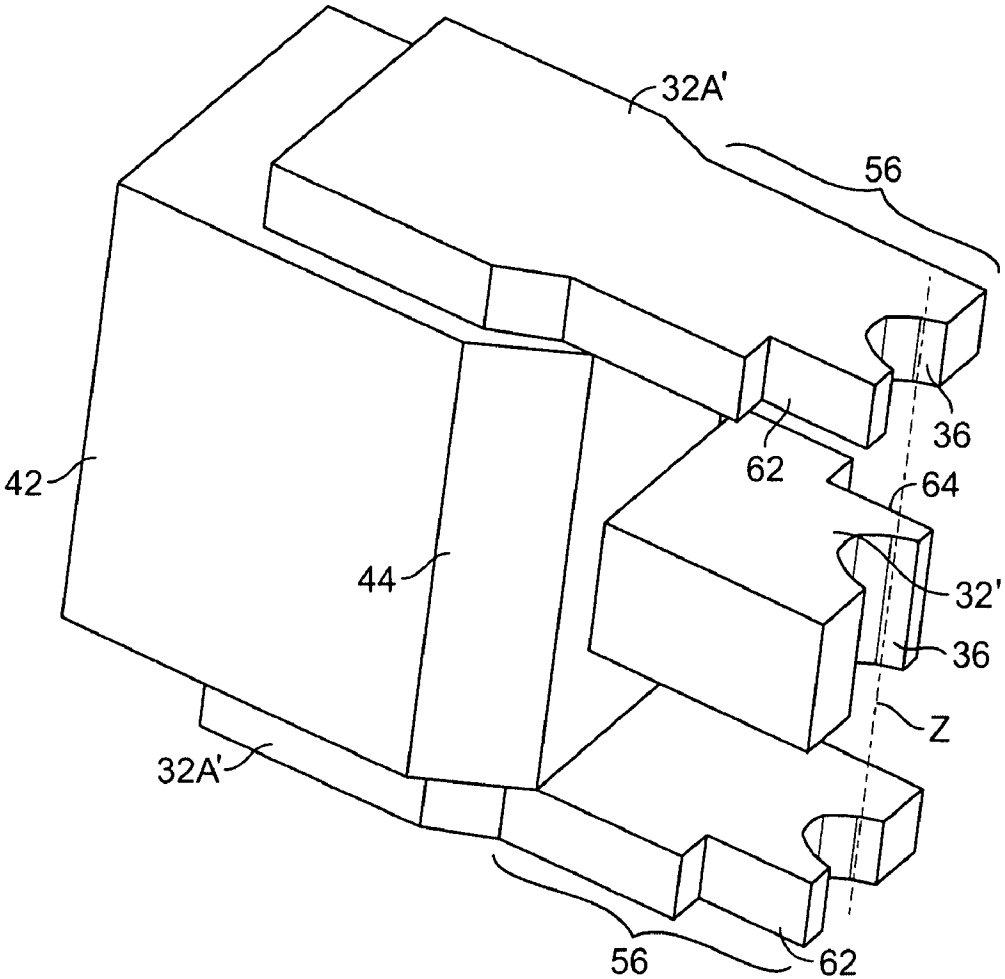
FIG. 5 is a partial perspective view of a portion of a PPM circuit that includes notches.

Referring now to FIGS. 5 and 6, an alternative embodiment of a coupled cavity circuit is illustrated. The end regions 56 of the elongated polepieces 32A' adjacent to the beam tunnel have portions of the material removed by tapering the width of the polepieces. Likewise, the short polepiece 32' has a reduced width as compared with the corresponding polepiece 32 of FIG. 3. The magnet 42 also includes a tapered portion 44 so that the end of the magnet adjacent to the beam tunnel is narrower. The elongated polepieces 32A' further include notches 62 that provide coupling irises between adjacent cavities of the coupled cavity circuit. FIGS. 5 and 6 further show axial line z extending along the center of the beam tunnel, and off-axial line z' parallel to and displaced radially from the axial line z.

Figure 7:
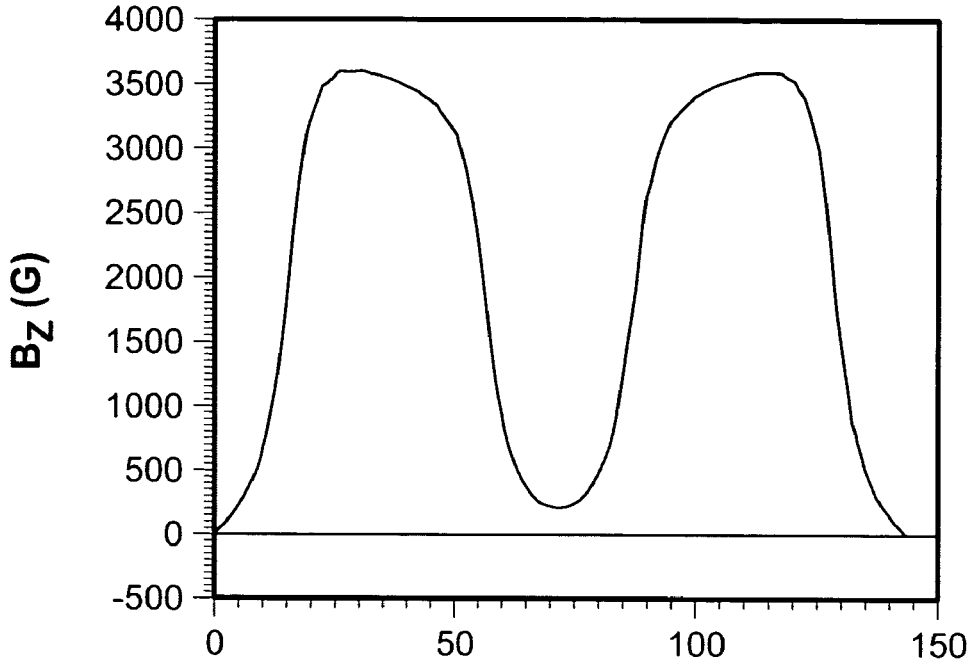
FIG. 7 is a graph illustrating the off-axial magnetic field measured inside the beam tunnel for the notched PPM circuit of FIGS. 5 and 6.

FIG. 7 provides a graph illustrating the axial magnetic field measured inside the beam tunnel for the coupled cavity circuit of FIGS. 5 and 6. As with FIG. 4 (described above), the vertical axis defines the measured magnetic field and the horizontal axis defines the axial position within the beam tunnel. In FIG. 7, the magnetic field is measured off-axis along the off-axial line z' and shows distinct distortions of the sinusoidally varying magnetic field. These distortions appear to correspond to locations between the polepieces inside the beam tunnel, and are deemed to be caused by the presence of the notches. These axial field distortions coincide with unwanted transverse magnetic field distortions.

Figure 8:
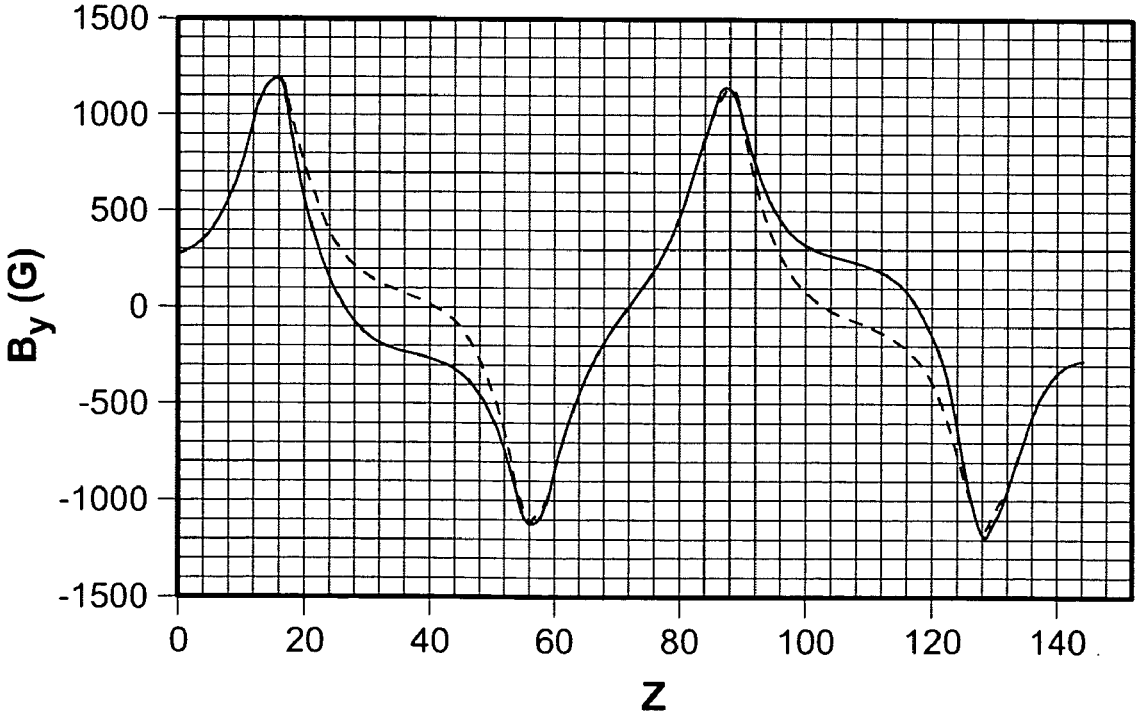
FIG. 8 is a graph plotting the Y component of the magnetic field measured along the off-axial measurement line of FIG. 6 compared with the Y component of the magnetic field along a line at the same radius across the tunnel.
Figure 9:
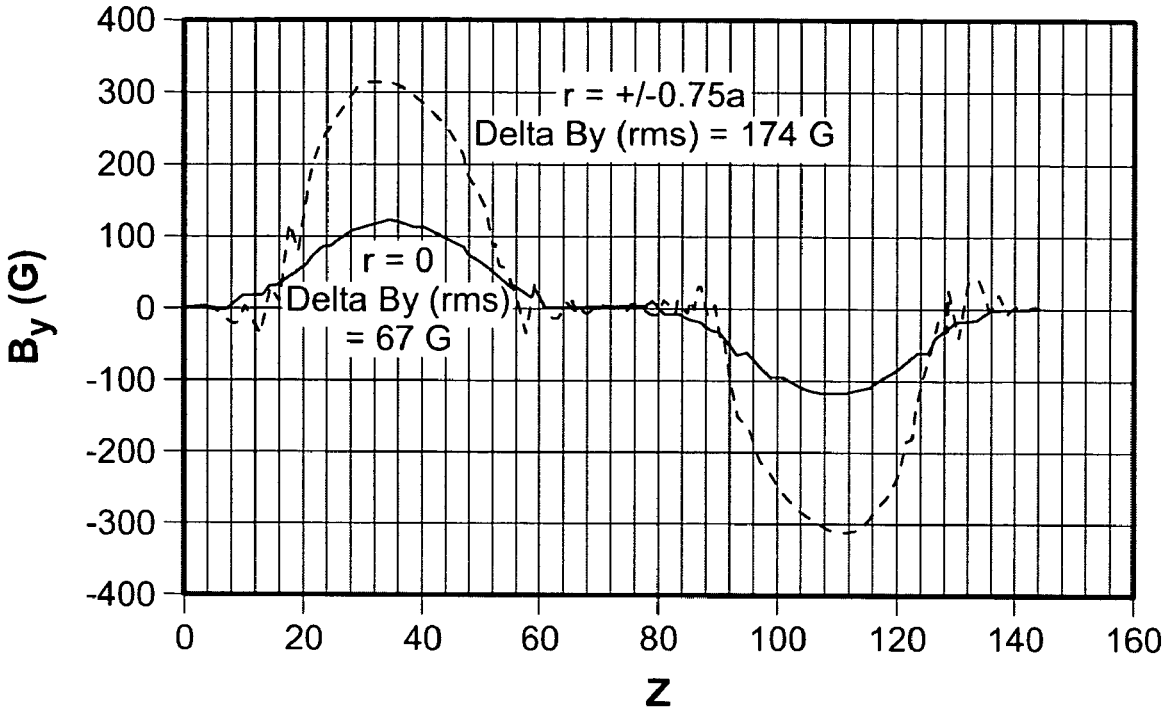
FIG. 9 is a graph plotting the transverse field imbalance off-axis compared to the transverse field on-axis.

In FIG. 8, a plot of the Y component of the magnetic field along the off-axial line z' described above is compared with the Y component of the magnetic field (in phantom) along a line at the same radius across the beam tunnel. The difference represents an imbalance of the transverse-magnetic-field forces on the beam. Such an imbalance distorts the beam and can move the beam into the wall. Although there should be no transverse fields on axis, a transverse field is present as a result of the notch-induced field distortions. FIG. 9 compares the size of the transverse field imbalance off-axis to the corresponding size of the transverse field on-axis. On-axis, the root-mean square average of the transverse field (RMS transverse field) is 2.8% of the RMS axial field. Off-axis, the RMS transverse field distortion is 6.9% of the RMS axial field.

Figure 10:
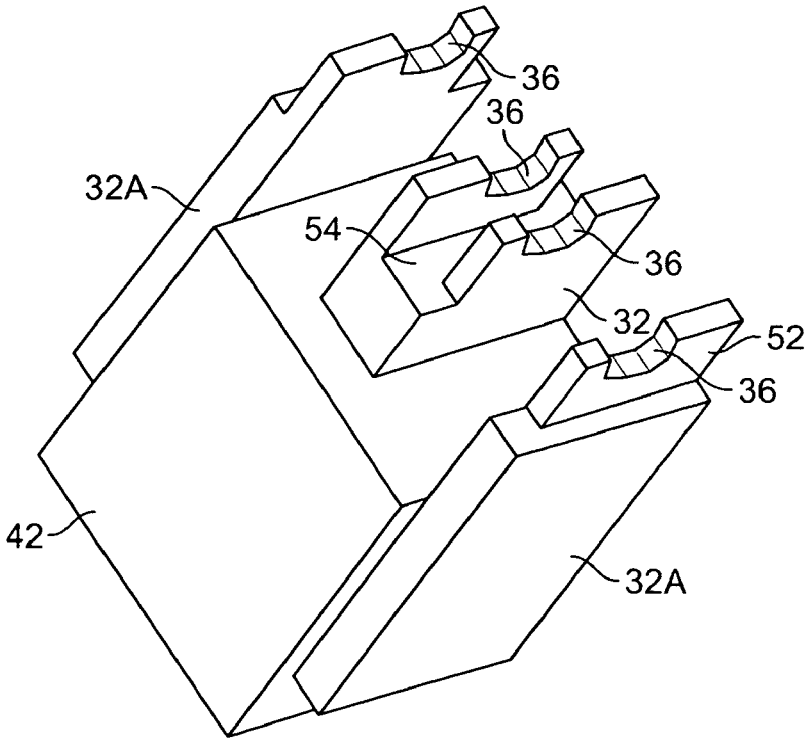
FIG. 10 is a partial perspective view of a portion of a conventional PPM circuit having voids within the polepieces in accordance with an embodiment of the invention.

Referring now to FIG. 10, a portion of a coupled cavity circuit of the present invention includes material of the polepieces 32A, 32 removed. In particular, the ends of the elongated polepieces 32A adjacent to the beam tunnel have portions of the material removed from one side to yield a thin polepiece 52 in the region of the beam tunnel. The thin polepiece 52 is also reduced in the width dimension to provide a notch for a coupling iris (as in FIGS. 5 and 6). Likewise, the short polepiece 32 has a central portion removed to define a gap 54 between a pair of thinner and narrower adjacent polepieces in the region of the beam tunnel. The spaces defined by the removed material serves as cavities for axially transverse field portions of a folded waveguide circuit (also referred to herein as "polepiece-cavities" to distinguish over cavities formed between polepieces). As will be further shown below, the inclusion of these spaces serves to improve the quality of the magnetic focusing field while maintaining generally high magnetic field levels.

Figure 11:
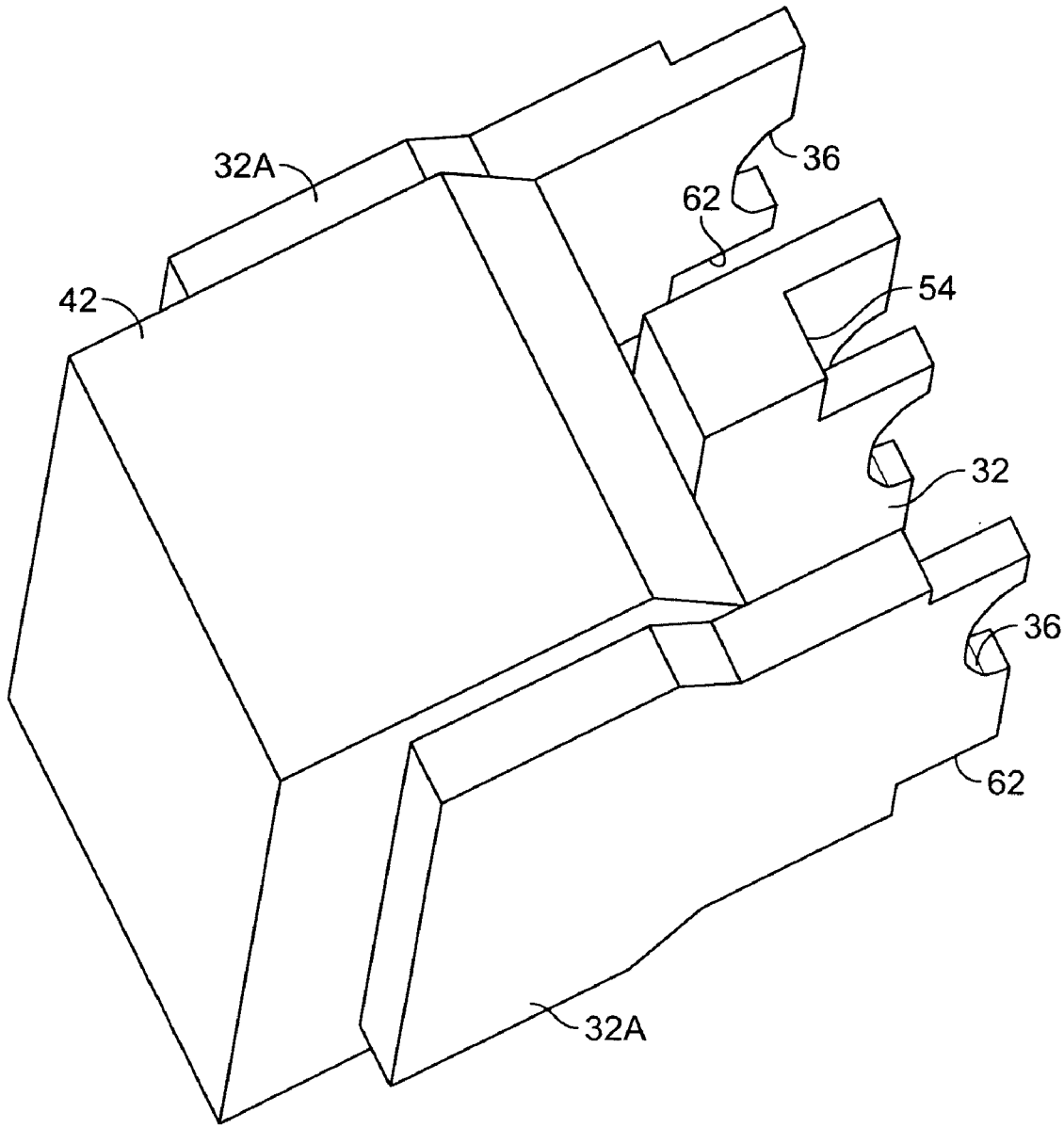
FIG. 11 is a partial perspective view of a portion of an alternative embodiment of a conventional coupled cavity circuit having voids within the polepieces.

FIG. 11 illustrates an alternative embodiment of a coupled cavity circuit of the present invention in which material of the polepieces 32A, 32 is removed. Instead of providing step-wise reduction in width of the polepieces 32A, a tapered reduction is provided. As in FIG. 10, the short polepiece 32 has a central portion removed to define a gap 54 between a pair of thinner and narrower adjacent polepieces in the region of the beam tunnel. The spaces defined by the removed material serves as cavities for axially transverse field portions of a folded waveguide circuit.

Figure 12:
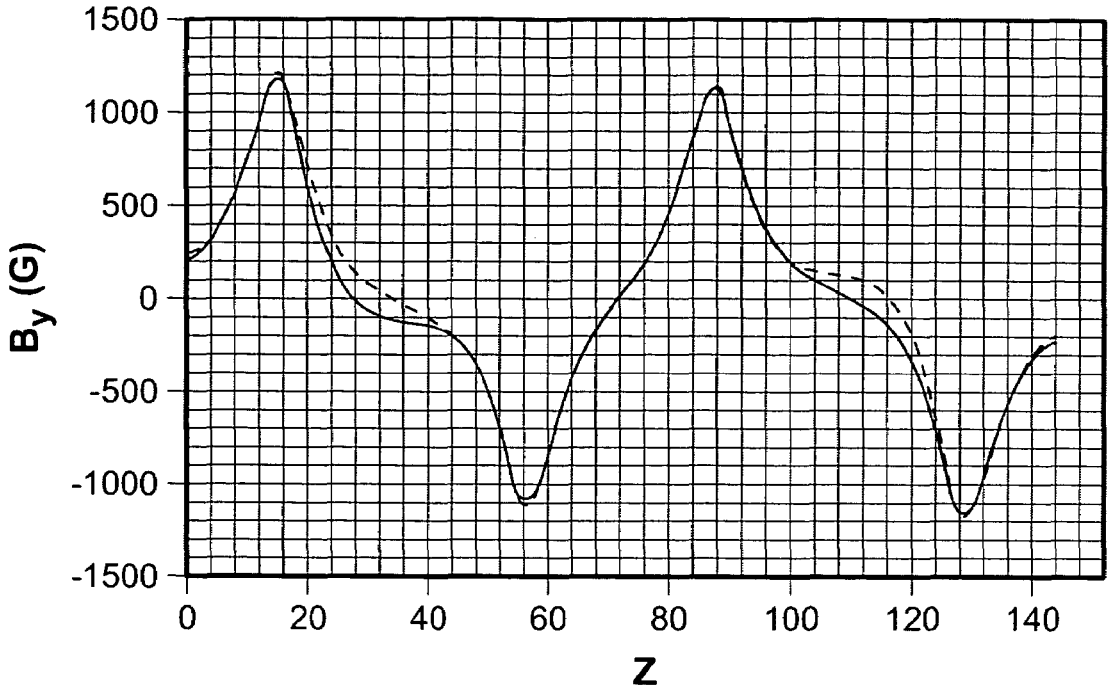
FIG. 12 is a graph plotting the Y component of the magnetic field measured along the off-axial measurement line compared with the Y component of the magnetic field along a line at the same radius across the tunnel, corresponding to the PPM circuit of FIG. 11.
Figure 13:
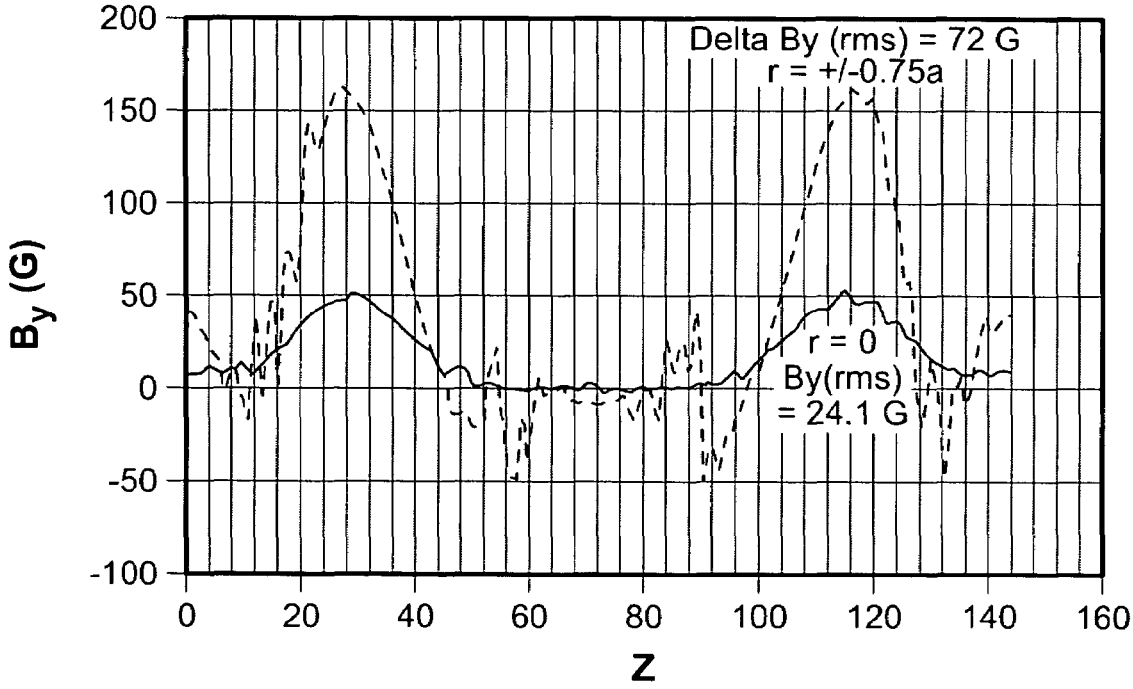
FIG. 13 is a graph plotting the transverse field imbalance off-axis compared to the transverse field on-axis for the PPM circuit of FIG. 11.

In FIG. 12 (as in FIG. 8), a plot of the Y component of the magnetic field along the off-axial line is compared with the Y component of the magnetic field (in phantom) along a line at the same radius across the beam tunnel for the coupled cavity circuits of FIGS. 10 and 11. Likewise, FIG. 13 compares the size of the transverse field imbalance off-axis to the corresponding size of the transverse field on-axis. Although there are still undesirable field distortions, on axis, the RMS transverse field is 1.0% of the RMS axial field. Thus, the inclusion of spaces within the polepieces reduces the transverse field on-axis by roughly 66%. Off axis, the RMS transverse field distortion is 2.9% of the RMS axial field, i.e., a reduction of the transverse field off-axis by roughly 60%. The ratio of the RMS axial field of the present invention and that of the prior art is 0.9912. Thus, there is no significant axial field reduction notwithstanding the significant transverse field reduction.

In other words, the coupled-cavity circuit of the present invention uses thick polepieces to maximize the magnetic flux transported to the beam tunnel, while at the same time increasing the number of cavities and decreasing the spacing between cavities by disposing cavities within the polepieces. This provides higher magnetic flux levels in the beam tunnel, enabling the focusing of higher powered electron beams and higher RF output power. The present coupled cavity circuit utilizes the interior of the ferromagnetic polepieces as part of the cavity-slow-wave structure in order to enable high-power PPM-focused electron beams with higher frequency electromagnetic signals. When such cavities are placed at the magnetic-field minima, the deleterious field distortions that result from the coupling irises are reduced without significant reduction in the main focusing field strength. Preferably, this coupled cavity circuit provides interaction with higher frequencies without decreasing the beam power while maintaining lightweight, compact size.

Having thus described a preferred embodiment of a folded waveguide traveling wave tube having a polepiece-cavity coupled-cavity circuit, it should be apparent to those skilled in the art that certain advantages of the system have been achieved. It should also be appreciated that various modifications, adaptations, and alternative embodiments thereof may be made within the scope and spirit of the present invention. The invention is defined solely by the following claims.

What is claimed is:

1. An amplifying device, comprising:

an electron gun emitting an electron beam;

a collector spaced from the electron gun, the collector oriented to collect electrons of the electron beam emitted from the electron gun; and an interaction structure interposed between the electron gun and the collector, defining an electromagnetic path along which an applied electromagnetic signal interacts with the electron beam, the interaction structure further comprising a plurality of polepieces and a plurality of magnets, the polepieces each having an aligned opening to collectively provide an electron beam tunnel having an axis extending between the electron gun and the collector to define an electron beam path for the electron beam, the polepieces providing a magnetic flux path to the electron beam tunnel from the magnets;

wherein the interaction structure further includes plural cavities defined therein interconnected to provide a coupled cavity circuit, at least one of the plurality of polepieces separating adjacent ones of the plural cavities and having an iris for coupling the electromagnetic signal therethrough, at least one of the plurality of polepieces further having a void that crosses the electron beam tunnel and is aligned perpendicularly to the beam tunnel axis.

2. The amplifying device of claim 1, wherein the plurality of polepieces are comprised of ferromagnetic material.

3. The amplifying device of claim 1, further comprising a plurality of non-ferromagnetic plates interposed with the plurality of polepieces.

4. An amplifying device, comprising:

an electron gun emitting an electron beam;

a collector spaced from the electron gun, the collector oriented to collect electrons of the electron beam emitted from the electron gun; and an interaction structure interposed between the electron gun and the collector, defining an electromagnetic path along which an applied electromagnetic signal interacts with the electron beam, the interaction structure further comprising a plurality of polepieces and a plurality of magnets, the polepieces each having an aligned opening to collectively provide an electron beam tunnel having an axis extending between the electron gun and the collector to define an electron beam path for the electron beam, the polepieces providing a magnetic flux path to the electron beam tunnel from the magnets;

wherein the interaction structure further includes plural cavities defined therein interconnected to provide a coupled cavity circuit, at least one of the plurality of polepieces separating adjacent ones of the plural cavities and having an iris for coupling the electromagnetic signal therethrough, at least one of the plurality of polepieces further having a void aligned perpendicularly to the beam tunnel axis;

wherein at least one of the polepieces further comprises a first thickness in a first region adjacent to the respective aligned opening and a second thickness in a second region displaced from the aligned opening, the first thickness being smaller than the second thickness.

5. The amplifying device of claim 4, wherein the at least one of the polepieces further comprise a step defined between the first and second regions.

6. The amplifying device of claim 4, wherein the at least one of the polepieces further comprise a taper defined between the first and second regions.

7. The amplifying device of claim 1, wherein the void is disposed substantially within at least one of the plurality of polepieces.

8. The amplifying device of claim 1, wherein the void is disposed at a side surface of at least one of the plurality of polepieces.

9. An amplifying device, comprising:

an electron gun emitting an electron beam;

a collector spaced from the electron gun, the collector oriented to collect electrons of the electron beam emitted from the electron gun; and an interaction structure interposed between the electron gun and the collector, defining an electromagnetic path along which an applied electromagnetic signal interacts with the electron beam, the interaction structure further comprising a plurality of polepieces and a plurality of magnets, the polepieces each having an aligned opening to collectively provide an electron beam tunnel having an axis extending between the electron gun and the collector to define an electron beam path for the electron beam, the polepieces providing a magnetic flux path to the electron beam tunnel from the magnets;

wherein the interaction structure further includes plural cavities defined therein interconnected to provide a coupled cavity circuit, at least one of the plurality of polepieces separating adjacent ones of the plural cavities and having an iris for coupling the electromagnetic signal therethrough, at least one of the plurality of polepieces further having a void aligned perpendicularly to the beam tunnel axis;

wherein the plurality of polepieces further comprise a plurality of elongated polepieces interposed with a plurality of short polepieces.

10. In an amplifying device comprising an electron gun emitting an electron beam and a collector spaced from the electron gun, the collector oriented to collect electrons of the electron beam emitted from the electron gun, an interaction structure interposed between the electron gun and the collector, defining an electromagnetic path along which an applied electromagnetic signal interacts with the electron beam, the interaction structure comprising:

a plurality of polepieces and a plurality of magnets, the polepieces each having an aligned opening to collectively provide an electron beam tunnel having an axis extending between the electron gun and the collector to define an electron beam path for the electron beam, the polepieces providing a magnetic flux path to the electron beam tunnel from the magnets;

wherein the interaction structure further includes plural cavities defined therein interconnected to provide a coupled cavity circuit, at least one of the plurality of polepieces separating adjacent ones of the plural cavities and having an iris for coupling the electromagnetic signal therethrough, at least one of the plurality of polepieces further having a void that crosses the electron beam tunnel and is aligned perpendicularly to the beam tunnel axis.

11. The interaction structure of claim 10, wherein the plurality of polepieces are comprised of ferromagnetic material.

12. The interaction structure of claim 10, further comprising a plurality of non-ferromagnetic plates interposed with the plurality of polepieces.

13. In an amplifying device comprising an electron gun emitting an electron beam and a collector spaced from the electron gun, the collector oriented to collect electrons of the electron beam emitted from the electron gun, an interaction structure interposed between the electron gun and the collector, defining an electromagnetic path along which an applied electromagnetic signal interacts with the electron beam, the interaction structure comprising:

a plurality of polepieces and a plurality of magnets, the polepieces each having an aligned opening to collectively provide an electron beam tunnel having an axis extending between the electron gun and the collector to define an electron beam path for the electron beam, the polepieces providing a magnetic flux path to the electron beam tunnel from the magnets;

wherein the interaction structure further includes plural cavities defined therein interconnected to provide a coupled cavity circuit, at least one of the plurality of polepieces separating adiacent ones of the plural cavities and having an iris for coupling the electromagnetic signal therethrough, at least one of the plurality of polepieces further having a void aligned perpendicularly to the beam tunnel axis;

wherein at least one of the polepieces further comprises a first thickness in a first region adjacent to the respective aligned opening and a second thickness in a second region displaced from the aligned opening, the first thickness being smaller than the second thickness.

14. The interaction structure of claim 13, wherein the at least one of the polepieces further comprise a step defined between the first and second regions.

15. The interaction structure of claim 13, wherein the at least one of the polepieces further comprise a taper defined between the first and second regions.

16. The interaction structure of claim 10, wherein the void is disposed substantially within at least one of the plurality of polepieces.

17. The interaction structure of claim 10, wherein the void is disposed at a side surface of at least one of the plurality of polepieces.

18. In an amplifying device comprising an electron gun emitting an electron beam and a collector spaced from the electron gun, the collector oriented to collect electrons of the electron beam emitted from the electron gun, an interaction structure interposed between the electron gun and the collector, defining an electromagnetic oath along which an applied electromagnetic signal interacts with the electron beam, the interaction structure comprising:

a plurality of polepieces and a plurality of magnets, the polepieces each having an aligned opening to collectively provide an electron beam tunnel having an axis extending between the electron gun and the collector to define an electron beam path for the electron beam, the polepieces providing a magnetic flux path to the electron beam tunnel from the magnets;

wherein the interaction structure further includes plural cavities defined therein interconnected to provide a coupled cavity circuit, at least one of the plurality of polepieces separating adiacent ones of the plural cavities and having an iris for coupling the electromagnetic signal therethrough, at least one of the plurality of polepieces further having a void aligned perpendicularly to the beam tunnel axis;

wherein the plurality of polepieces further comprise a plurality of elongated polepieces interposed with a plurality of short polepieces.

* * * * *